US012781323B2

(12) United States Patent
Zhao et al.

(10) Patent No.: US 12,781,323 B2
(45) Date of Patent: Nov. 3, 2026

(54) STEEL FOR HIGH-TEMPERATURE CARBURIZED GEAR SHAFT AND MANUFACTURING METHOD FOR STEEL

(71) Applicant: BAOSHAN IRON & STEEL CO., LTD., Shanghai (CN)

(72) Inventors: Sixin Zhao, Shanghai (CN); Jiaqiang Gao, Shanghai (CN); Zongze Huang, Shanghai (CN)

(73) Assignee: BAOSHAN IRON & STEEL CO., LTD., Shanghai (CN)

( * ) Notice: Subject to any disclaimer, the term of this patent is extended or adjusted under 35 U.S.C. 154(b) by 416 days.

(21) Appl. No.: 18/287,864

(22) PCT Filed: Apr. 19, 2022

(86) PCT No.: PCT/CN2022/087739

§ 371 (c)(1),
(2) Date: Oct. 20, 2023

(87) PCT Pub. No.: WO2022/228216

PCT Pub. Date: Nov. 3, 2022

(65) Prior Publication Data

US 2024/0360538 A1 Oct. 31, 2024

(30) Foreign Application Priority Data

Apr. 29, 2021 (CN) ..... 202110478480.2

(51) Int. Cl.

| | |
|---|---|
| ***C22C 38/26*** | (2006.01) |
| ***C21D 1/18*** | (2006.01) |
| ***C21D 1/26*** | (2006.01) |
| ***C21D 7/13*** | (2006.01) |
| ***C21D 9/28*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/24*** | (2006.01) |
| ***C22C 38/28*** | (2006.01) |

(52) U.S. Cl.

CPC ..... *C22C 38/26* (2013.01); *C21D 1/18* (2013.01); *C21D 1/26* (2013.01); *C21D 7/13* (2013.01); *C21D 9/28* (2013.01); *C22C 38/001* (2013.01); *C22C 38/02* (2013.01); *C22C 38/04* (2013.01); *C22C 38/06* (2013.01); *C22C 38/24* (2013.01); *C22C 38/28* (2013.01)

(58) Field of Classification Search

CPC ..... C22C 38/26; C22C 38/001; C22C 38/02; C22C 38/04; C22C 38/06; C22C 38/24; C22C 38/28; C22C 38/32; C22C 38/42; C22C 38/44; C22C 38/46; C22C 38/48; C22C 38/50; C22C 38/54; C22C 33/04; C22C 38/60; C21D 1/18; C21D 1/26; C21D 7/13; C21D 9/28; C21D 6/002; C21D 8/06; C23C 8/22

USPC ..... 420/104

See application file for complete search history.

(56) References Cited

FOREIGN PATENT DOCUMENTS

| | | | | |
|---|---|---|---|---|
| CN | 102560255 | A | | 7/2012 |
| CN | 103361559 | A | | 10/2013 |
| CN | 104946991 | A | | 9/2015 |
| CN | 106967925 | A | | 2/2017 |
| CN | 108866439 | A | | 11/2018 |
| CN | 109402498 | A | | 3/2019 |
| CN | 111850412 | A | | 2/2020 |
| CN | 111286671 | A | | 6/2020 |
| CN | 112322997 | A | | 2/2021 |
| JP | 2001279383 | A | * | 10/2001 |
| JP | 2004204263 | A | | 7/2004 |
| JP | 2004300472 | A | | 10/2004 |
| JP | 3725666 | B2 | | 12/2005 |
| JP | 3738004 | B2 | | 1/2006 |
| JP | 3804041 | B2 | | 8/2006 |
| JP | 2006249570 | A | | 9/2006 |
| JP | 2007030129 | A | | 2/2007 |

(Continued)

OTHER PUBLICATIONS

JP2001279383A Translation (Year: 2001).*
KR20050095070A Translation (Year: 2005).*
International Search Report and Written Opinion in Application No. PCT/CN2022/087739 dated Jul. 11, 2022 (with English translation of ISR), 10 pages.
First Search in Chinese Application No. 202110478480.2 dated Nov. 30, 2022, 3 pages.
Examination Search Report for Canadian Patent Application No. 3,217,486 dated Oct. 29, 2024 (3 pages).

(Continued)

*Primary Examiner* — Danielle M. Carda
(74) *Attorney, Agent, or Firm* — Barclay Damon LLP

(57) ABSTRACT

Disclosed are a steel for a high-temperature carburized gear shaft and a manufacturing method for the steel. The steel for the high-temperature carburized gear shaft comprises the following chemical components in percentage by mass: 0.17-0.22% of C, 0.05-0.35% of Si, 0.80-1.40% of Mn, 0.010-0.035% of S, 0.80-1.40% of Cr, 0.020-0.046% of Al, 0.006-0.020% of N, 0.002-0.030% of Nb, V≤0.02%, and Ti≤0.01%. Also disclosed is a manufacturing method for the steel for the high-temperature carburized gear shaft, comprising the steps of: smelting and casting; heating; forging or rolling; and finishing. By reasonably controlling chemical element compositions of the steel, the steel for the gear shaft in the present invention can maintain proper austenite grain size and stability at high temperature, maintains 5-8 grades of the austenite grain size before and after the high-temperature vacuum carburizing at 940-1050° C., can be effectively applied to high-end parts such as a gearbox for a vehicle or a speed reducer and a differential of a new energy vehicle, and has good application prospects and value.

14 Claims, No Drawings

(56) References Cited

FOREIGN PATENT DOCUMENTS

| | | | | |
|---|---|---|---|---|
| JP | 5643622 | B2 | | 12/2014 |
| JP | 2015127434 | A | | 7/2015 |
| JP | 2017082310 | A | | 5/2017 |
| JP | 2018165403 | A | | 10/2018 |
| KR | 10-2005-0095070 | A | | 9/2005 |
| KR | 20050095070 | A | * | 9/2005 |
| KR | 100551588 | B1 | | 2/2006 |
| KR | 10-2009-0037631 | A | | 4/2009 |

OTHER PUBLICATIONS

Supplementary European Search Report for European Patent Application No. 22794687.8 dated Dec. 17, 2024 (9 pages).
Notice of Reasons for Refusal for Japanese Patent Application No. 565455/2023 mailed Nov. 5, 2024 (17 pages.).
Official Action for Russian Patent Application No. 2023128994 dated Apr. 24, 2024 (6 pages).
Decision of Grant of Russian Patent Application No. 2023128994 dated Sep. 2, 2024 (14 pages).
The Korean Intellectual Property Office Notice of Office Action; Korean Patent Application No. 10-2023-7035842; Date of Transmission Apr. 10, 2025 (10 pages).

* cited by examiner

STEEL FOR HIGH-TEMPERATURE CARBURIZED GEAR SHAFT AND MANUFACTURING METHOD FOR STEEL

CROSS-REFERENCE TO RELATED APPLICATIONS

This application is a U.S. national phase entry under 35 USC § 371 of Patent Cooperation Treaty Application No. PCT/CN2022/087739 filed Apr. 19, 2022, which in turn claims priority from Chinese Patent Application No. 202110478480.2, filed Apr. 29, 2021. Each of the above-described applications is hereby incorporated herein by reference in their entirety.

TECHNICAL FIELD

The present invention relates to the technical field of metallurgy, in particular to a steel for a high-temperature carburized gear shaft and a manufacturing method for the steel.

BACKGROUND

With the in-depth development of the globalization of the automobile industry, the demands of a market and users for safety, environmental protection and comfort of automobiles are increasing, and the technical requirements for automotive parts are also increasing. It is one of the important development directions to obtain gear or shaft parts with high temperature stability, high fatigue life, easy machining and economic efficiency.

The surface of a high-performance gear or shaft part is usually treated by carburizing, quenching and tempering to obtain a surface with higher hardness and a core with better toughness, and finally obtain excellent fatigue life and wear resistance. In recent years, in the face of the high technical requirements for gears in automobiles, especially in speed reducers and differentials of new energy vehicles, the high-temperature carburizing technology is widely used, which can not only obtain carburized gears with excellent performance, but also greatly improve the production efficiency, reduce gas emission and protect the environment.

At present, the commonly used gas carburizing temperature at home and abroad is generally not higher than 930° C., while the temperature of high-temperature vacuum carburizing can be as high as 960° C. and even 1000° C. or more because of its oxygen-free processing environment. According to the carburizing principle, the carburizing time for obtaining a hardened layer of the same thickness can be shortened by about 50% by increasing the carburizing temperature by about 50° C. Therefore, if the carburizing temperature is increased from 930° C. to 980° C., the carburizing time can be shortened to 50% of the original carburizing time, and the production efficiency will be significantly improved. In addition, a gear obtained by high-temperature vacuum carburizing has little or no intergranular oxidation on the surface, which can obviously improve the impact fracture resistance. The high-temperature vacuum carburizing technology has gradually become an inevitable choice to replace the gas carburizing technology due to its own advantages.

At present, the widely used MnCr-based carburized gear steel is also widely used in speed reducers and differentials of new energy vehicles because of its excellent comprehensive cost performance. The main technical problem of the MnCr-based high-temperature carburized gear steel is how to increase the carburizing temperature while avoiding the phenomenon of mixed crystal and coarse grains in gears; once abnormal grain growth occurs, heat treatment deformation and early fatigue fracture are easily caused, and there is a possibility of affecting the transmission efficiency and causing traffic accidents. Moreover, in order to cope with quenching and tempering of gears with a complex shape, gas quenching with high-temperature vacuum carburizing is widely used, and higher requirements are also put forward for the hardenability of gear steel.

Experimental studies have shown that the addition of elements such as Al, Nb, V, Ti, and N to the MnCr-based carburized gear steel can prevent grain coarsening during high-temperature carburizing by using carbonitrides. However, there are still problems that the grain coarsening temperature of gears is not high enough, and that a grain size of gear steel obtained by mass production is unstable.

For example, Chinese invention patent No. CN200610028265.8 describes a high-strength gear steel for an automotive, wherein alloy elements such as Nb, V, and Al are compositely added to the steel to refine original austenite grains, and the steel includes the following components in percentage by mass: 0.20-0.40% C, 0.20-0.50% Si, 0.50-1.00% Mn, 0.80-1.30% Cr, 0.015-0.080% Nb, 0.030-0.090% V, 0.15-0.55% Mo, and 0.015-0.050% Al, the balance being Fe and inevitable impurities. By adding a trace amount of Nb and V, the grain size, hardenability and bandwidth of the gear steel are all significantly optimized; at the same time, the comprehensive mechanical properties of the gear steel are increased and the service life is prolonged. However, this patent does not describe a specific carburizing temperature, and the addition of microalloying elements such as Al, Nb and V can only meet the temperature requirements of conventional gas carburizing.

For another example, Chinese invention patent No. CN201310301638.4 describes a NbTi composite microalloyed 20CrMnTi free-cutting gear steel, including the following components: 0.17-0.22% C, 0.20-0.35% Si, 0.9-1.10% Mn, 0.025% or less P, 0.020-0.035% S, 1.05-1.30% Cr, 0.015-0.035% Al, 0.02-0.06% Ti, and 0.02-0.06% Nb, the balance being iron and inevitable impurities. By controlling the content of microalloying elements such as Nb, Ti, and Al, the carburizing temperature of gears can be increased or the carburizing time can be shortened, e.g., 1050° C.*1 h or 1000° C.*6 h. In this patent, the addition of 0.02-0.06% Ti and Nb can increase the carburizing temperature to 1000° C.

For another example, Chinese invention patent No. CN202010128336.1 describes an ultra-pure high-temperature fine-grained carburized gear steel, including the following chemical components: 0.15-0.21% C, 0.12% or less Si, 1.00-1.30% Mn, 1.00-1.30% Cr, 0.010-0.025% S, 0.025% or less P, 0.70-1.00% Ni, 0.02-0.10% Mo, 0.0020-0.0040% B, 0.20% or less Cu, 0.05% or less Al, 0.0005% or less Ca, 0.003% or less Ti, and 0.0080-0.016% N, N=(0.80–1.0)×(0.5% Al+0.7% B), the balance being Fe and inevitable impurities. The steel still has a matrix grain size of 6 grade or more after high-temperature carburizing at 960° C. or more. In this patent, B element is added, and Al and B are sufficiently bonded to N to form AlN and BN particles, and thus obtain a gear round steel still with a grain size of 6 grade or more after high temperature treatment at 1000° C.*4 h.

Considering that the effect of V element in controlling a high-temperature austenite grain size is not obvious, square inclusions are easily formed after adding Ti element to affect the fatigue life, a higher content of B element is prone to segregation at a grain boundary, in order to meet the increasingly high technical requirements of carburized gear steel, it is extremely urgent to develop and manufacture a large-sized MnCr-based carburized steel for a gear shaft which is suitable for high-temperature (vacuum) carburizing and free-cutting.

SUMMARY

In view of the above analysis, the present invention aims to provide a steel for a high-temperature carburized gear shaft and a manufacturing method for the steel, so as to solve the problems existing in the prior art that a steel for a gear shaft can only meet the requirements of the conventional carburizing temperature, and heat treatment deformation and early fatigue fracture caused by grain coarsening and grain size instability are easily generated during high-temperature carburizing.

An object of the present invention is to provide a steel for a high-temperature carburized gear shaft. The steel for the gear shaft manufactured by using the elemental components of the present invention can maintain proper austenite grain size and stability at high temperature, has a narrow hardenability bandwidth, is easy to process, and can effectively improve the production stability and a use safety of the steel for the gear shaft. The steel for the gear shaft maintains 5-8 grades of the austenite grain size before and after the high-temperature carburizing at 940-1050° C., and can be effectively applied to high-end parts such as a gearbox for an automobile or a speed reducer and a differential for a new energy vehicle, and has good application prospects and value.

In order to achieve the above object, the present invention proposes a steel for a high-temperature carburized gear shaft, comprising the following chemical components in percentage by mass: 0.17-0.22% C, 0.05-0.35% Si, 0.80-1.40% Mn, 0.010-0.035% S, 0.80-1.40% Cr, 0.020-0.046% Al, 0.006-0.020% N, 0.002-0.030% Nb, 0.02% or less V, and 0.01% or less Ti. In the steel for the high-temperature carburized gear shaft according to the present invention, a design principle of each chemical element is specifically described as follows:

C: In the steel for the high-temperature carburized gear shaft of the present invention, C is an essential component in the steel, and at the same time, C is also one of the most important elements affecting the hardenability of the steel. The carburized gear steel requires both high surface strength and sufficient core impact toughness, and when the content of C in the steel is too low, i.e., less than 0.17%, the strength of the steel is insufficient and good hardenability is not guaranteed; accordingly, the content of the C element in the steel should not be too high. When the content of the C element in the steel is too high, the requirements for the core toughness of a gear are not satisfied, and too high a content of C is detrimental to the plasticity of the steel, particularly for a carburized gear steel having a high Mn content, and when the C content is greater than 0.22%, it is detrimental to the workability of the steel. Therefore, in the steel for the high-temperature carburized gear shaft of the present invention, the mass percentage of C is controlled to be 0.17-0.22%.

Si: In the steel for the high-temperature carburized gear shaft of the present invention, the Si element can not only better eliminate the adverse effect of iron oxide on the steel, but also be dissolved in ferrite, strengthening the ferrite, and improving the strength, hardness, wear resistance and elasticity and elastic limit of the steel. At the same time, it should be noted that the Si element will increase the $Ac_3$ temperature of the steel, reducing the thermal conductivity, thus making the steel have a risk of cracking and a tendency of decarburization. Based on this, considering the beneficial effects and adverse effects of Si in combination, in the steel for the high-temperature carburized gear shaft of the present invention, the mass percentage of Si is controlled to be 0.05-0.35%.

Mn: In the steel for the high-temperature carburized gear shaft of the present invention, Mn is one of the main elements affecting the hardenability of the steel. The Mn element is excellent in deoxidizing ability, can reduce iron oxide in the steel, and can effectively increase the yield of the steel. Mn can be dissolved into ferrite, can improve the strength and hardness of the steel, and can make the steel have pearlite with finer lamellae and higher strength when the steel is cooled after hot rolling. In addition, Mn can also form MnS with S in the steel, which can eliminate the harmful effects of S. Mn has the ability to form and stabilize an austenitic structure in the steel, can strongly increase the hardenability of the steel, and can also improve the hot workability of the steel. When the content of the Mn element in the steel is less than 0.80%, the hardenability of the steel is insufficient; when the content of the Mn element in the steel is too high, the thermoplasticity of the steel will be deteriorated, the production is affected, and the steel is prone to cracking during water quenching. Therefore, in the steel for the high-temperature carburized gear shaft of the present invention, the mass percentage of Mn is controlled to be 0.80-1.40%.

S: In the steel for the high-temperature carburized gear shaft of the present invention, S is generally present as an impurity element in the steel, and will significantly reduce the plasticity and toughness of the steel, a certain amount of S element can form non-metallic inclusions with Mn, and an appropriate amount of S can improve the cutting properties of the steel. Based on this, in the steel for the high-temperature carburized gear shaft of the present invention, the mass percentage of S is controlled to be 0.010-0.035%.

Cr: In the steel for the high-temperature carburized gear shaft of the present invention, Cr is one of the main alloying elements added to the steel of the present invention, and Cr can significantly improve the hardenability, strength, wear resistance, and the like of the steel. In addition, Cr can also reduce the activity of the C element in the steel and prevent decarburization during heating, rolling and heat treatment, but too high a content of Cr will significantly reduce the toughness of quenched and tempered steel, forming coarse carbides distributed along grain boundaries. Therefore, in the steel for the high-temperature carburized gear shaft of the present invention, the mass percentage of the Cr element is controlled to be 0.80-1.40%.

Al: In the steel for the high-temperature carburized gear shaft of the present invention, Al belongs to an element for refining grains. The combination of the Al element and N can further refine grains and improve the toughness of the steel. Grain refinement plays an important role in improving the mechanical properties of the steel, especially the strength and toughness, and meanwhile the grain refinement also helps to reduce the hydrogen embrittlement susceptibility of the steel. However, it should be noted that the content of the Al element in the steel should not be too high, and too high a content of Al will easily increase the chance of generating inclusions in the steel. Therefore, in the steel for the high-temperature carburized gear shaft of the present invention, the mass percentage of the Al element is controlled to be 0.020-0.046%.

N: In the steel for the high-temperature carburized gear shaft of the present invention, N is an interstitial atom that can be bonded to microalloys in the steel to form MN-type precipitates ("M" refers to alloying elements), which can pin grain boundaries at a high temperature, thereby inhibiting austenite grain growth. When the content of the N element in the steel is low, less MN is formed and the pinning effect is not significant; when the content of the N element in the steel is too high, the N element tends to be enriched in steel making, reducing the toughness of the steel. Therefore, in the steel for the high-temperature carburized gear shaft of the present invention, the mass percentage of the N element is controlled to be 0.006-0.020%.

Nb: In the steel for the high-temperature carburized gear shaft of the present invention, the addition of Nb element in the steel can form fine precipitates, thereby inhibiting the recrystallization of the steel and effectively refining grains. It should be noted that the content of the Nb element in the steel should be not too high, and when the Nb content in the steel is too high, coarse NbC particles will be formed during the smelting process, which will reduce the impact toughness of the steel. Therefore, in the steel for the high-temperature carburized gear shaft of the present invention, the mass percentage of the Nb element is controlled to be 0.002-0.030%.

V: In the steel for the high-temperature carburized gear shaft of the present invention, V can effectively improve the hardenability of the steel. The V element may form precipitates with the C element or the N element in the steel, thereby further improving the strength of the steel. If the content of the C element and the content of the V element are too high, coarse VC particles will be formed. In view of the production cost and competitiveness, in the steel for the high-temperature carburized gear shaft of the present invention, the mass percentage of the V element is controlled to be 0.02% or less.

Ti: adding Ti to the steel can form fine precipitates, but when the content of the Ti element in the steel is too high, coarse TiN particles with edges and corners will be formed during the smelting process, thereby reducing the impact toughness of the steel. Therefore, the content of the Ti element in the steel for the high-temperature carburized gear shaft of the present invention is controlled to be 0.01% or less.

Preferably, the steel for the high-temperature carburized gear shaft of the present invention may further comprise at least one of elements Ni, Mo and Cu, in percentage by mass, 0.25% or less Ni, 0.10% or less Mo, and 0.20% or less Cu.

In the present invention, the elements Ni, Mo and Cu can further improve the performance of the steel for the high-temperature carburized gear shaft of the present invention.

Ni: In the steel for the high-temperature carburized gear shaft of the present invention, Ni exists in the form of solid solution in the steel, and can effectively improve the low-temperature impact performance of the steel. However, it should be noted that too high a content of Ni will result in too high a content of retained austenite in the steel, thereby reducing the strength of the steel. Therefore, considering the production cost and competitiveness, in the steel for the high-temperature carburized gear shaft of the present invention, the mass percentage of Ni can be preferably controlled to be 0.25% or less.

Mo: In the steel for the high-temperature carburized gear shaft of the present invention, Mo can be solid-dissolved in the steel, which is beneficial to improve the hardenability of the steel and the strength of the steel. Tempering at a higher temperature will form fine carbides to further improve the strength of the steel; and the combination action of molybdenum and manganese can significantly improve the stability of austenite. Considering that Mo is a precious metal and its cost is high, in order to control the production cost, in the steel for the high-temperature carburized gear shaft of the present invention, the mass percentage of Mo can be preferably controlled to be 0.10% or less.

Cu: In the steel for the high-temperature carburized gear shaft of the present invention, Cu can improve the strength of the steel, and is beneficial to improve the weather resistance and corrosion resistance of the steel. The content of the Cu element in the steel should not be too high, and if the Cu content in the steel is too high, Cu will be enriched at grain boundaries during heating, resulting in weakening of the grain boundaries and cracking. Therefore, in the steel for the high-temperature carburized gear shaft of the present invention, the mass percentage of Cu can be preferably controlled to be 0.20% or less.

Preferably, in the steel for the high-temperature carburized gear shaft of the present invention, among the inevitable impurities, the content of each impurity element satisfies the following requirements: P≤0.015%, O≤0.0020%, H≤0.0002%, B≤0.0010%, and Ca≤0.003%.

In the present invention, P, O, H, B and Ca are all impurity elements in the steel, and the content of the impurity elements in the steel should be reduced as much as possible in order to obtain a steel with better performance and better quality if the technical conditions allow.

P: P is easily segregated at a grain boundary in the steel, which will reduce the grain boundary bonding energy and deteriorate the impact toughness of the steel. Therefore, in the steel for the high-temperature carburized gear shaft of the present invention, the P content is controlled to be 0.015% or less.

O: O can form oxides and composite oxides and the like with the Al element in the steel, and in order to ensure the uniformity of a steel structure and the low-temperature impact energy and fatigue performance, the content of the O element in the steel for the high-temperature carburized gear shaft of the present invention can be controlled to be 0.0020% or less.

H: H will accumulate at defects in the steel, and in a steel with a tensile strength exceeding 1000 MPa, hydrogen-induced delayed fracture will occur. Therefore, in the steel for the high-temperature carburized gear shaft of the present invention, the content of the H element is controlled to be 0.0002% or less.

B: B is an element that is more sensitive to hardenability, a small change in B content will cause a large fluctuation in hardenability of the steel because the B element is easily segregated, and adding the B element to the steel for the gear shaft is not conducive to narrow amplitude control of hardenability bandwidth for gear steel. Therefore, in the steel for the high-temperature carburized gear shaft of the present invention, the content of the B element is controlled to be 0.0010% or less.

Ca: In the steel for the high-temperature carburized gear shaft of the present invention, the Ca element easily forms inclusions, thereby affecting the fatigue performance of a final product. Therefore, the content of the Ca element can be controlled to be 0.003% or less.

Preferably, the present invention defines a microalloying element coefficient $r_{M/X}$ to describe the fine dispersion of MX (X refers to C or N) precipitates, wherein $r_{M/X}=(20*[Nb]/93-[V]/51+[Al]/27)/([N]/14+[C]/120)$, and each chemical element in the formula is substituted with a numerical value before a percentage sign of the percentage content by mass of the corresponding chemical element. In the present invention, Nb, V, Ti, and Al can all form MX microalloy precipitates, which plays a certain role in refining austenite grains and maintaining grain stability. Studies have found that under the temperature conditions used in the steel for the gear shaft of the present invention, in the process of forming nano-sized carbonitride precipitates MX, V and Nb have a competitive relationship, further increasing the content of the V element does not have a significant effect on controlling the high-temperature austenite grain size, while the Ti element itself easily forms inclusions with carbon and nitrogen elements, affecting the machinability of the steel, and it is also easy for the Ti element to complex with Nb to form large inclusions during smelting, affecting the effect of Nb precipitates in refining austenite grains. Therefore, in the present invention, finely dispersed MX precipitates are formed mainly by controlling the amount of two elements Nb and Al, particularly the microalloying element Nb, so as to keep austenite grains stable at a high temperature. Based on the above analysis, the microalloying element coefficient $r_{M/X}$ of the present invention is calculated as described above and ranges from 0.5 to 3.0. During the smelting process, the microalloying element coefficient needs to be controlled within a suitable range: if the microalloying element coefficient is too large, it is easy to form coarse precipitates during the smelting process, reducing the impact toughness and fatigue life of the steel; and if the microalloying element coefficient is too small, a suitable amount of fine precipitates will not be formed, which cannot achieve the purpose of pinning grain boundaries, inhibiting grain boundary movement, and thereby inhibiting austenite grain growth.

One of the positive effects of the present invention is that by controlling the content of microalloying elements and carbon and nitrogen elements and the microalloying element coefficient in gear steel, a proper amount of Al and Nb form precipitates with excess nitrogen and carbon elements, thus effectively inhibiting austenite grain growth at a high temperature stage.

Preferably, the steel for the high-temperature carburized gear shaft of the present invention has a hardenability of 30-43 HRC at a representative position J9 mm, and maintains 5-8 grades of an austenite grain size before and after high-temperature vacuum carburizing at 940-1050° C.

Another object of the present invention is to provide a manufacturing method for the steel for the high-temperature carburized gear shaft. The manufacturing method is simple to produce, and high in adaptability, and the steel for the high-temperature carburized gear shaft manufactured by the method of the present invention has high-temperature austenite stability, narrow hardenability bandwidth, high toughness, free cutting, high dimensional accuracy, high fatigue performance, and the like, can be effectively applied to highly demanding parts such as a gearbox for an automobile or a speed reducer and a differential for a new energy vehicle, and has good promotion prospects and application value.

In order to achieve the above object, the present invention proposes a manufacturing method for the steel for the high-temperature carburized gear shaft, including the steps of:

smelting and casting;
heating;
forging or rolling; and
finishing.

The smelting in the smelting and casting step of the manufacturing process of the present invention may be carried out by electric furnace smelting or converter smelting, and refining and vacuum treatment, such as external refining and vacuum degassing are carried out. Of course, in some other embodiments, a vacuum induction furnace may be used for the smelting. A furnace charge for electric furnace smelting can use low P and S scrap steel, cutting ends and high-quality pig iron; alloys can be ferrochrome, low phosphorus ferromanganese, ferromolybdenum, etc.; a reducing agent may include: calcium carbide, carbon powder, and aluminum powder; during the oxidation period: frequently flowing slag for removing P, and frequently flowing slag means a process that takes away the P element by increasing the number of slag flowing and the amount of steel slag, reducing the P content in the steel; the slag discharge conditions may be controlled as follows: the slag discharge temperature is 1630-1660° C.; and [P]≤0.015%; and the tapping conditions may be controlled as follows: the tapping temperature is 1630-1650° C.; [P]≤0.011%, and [C]≤0.03%.

After completion of the electric furnace smelting or converter smelting, it is necessary to refine molten steel in a ladle refining furnace to remove harmful gases and inclusions in the steel. Control ladle seating, temperature measurement and analysis, and the argon pressure can be adjusted according to the situation; initial deoxidation of LF can be achieved by feeding 0.04% Al, and then adding alloy blocks and stirring for 5-10 minutes. When the temperature of molten steel is measured to be T=1650-1670° C., vacuum degassing may be performed, and a vacuum degree of the vacuum degassing may be controlled to be 66.7 Pa and kept for not less than 15 minutes to ensure [O]≤0.0020% and [H]≤0.00015%. In addition, in this technical solution, the temperature of a crane ladle can be controlled to be 1550-1570° C., and since the temperature of the crane ladle is reduced, the element diffusion is accelerated, which is beneficial to further reducing dendritic segregation.

Accordingly, the casting may be performed by die casting or continuous casting. During the continuous casting process, high-temperature molten steel in the steel ladle is poured into a tundish through a protective sleeve, wherein a superheat degree of the tundish is 20-40° C. The tundish is completely cleaned before use, and the inner surface of the tundish is coated with a refractory coating and must not have cracks; and the molten steel in the tundish is fully stirred by electromagnetic stirring through a continuous casting crystallizer so that a qualified continuous casting billet having a cross-sectional dimension of 140 mm×140 mm to 320 mm×425 mm can be obtained. In this technical solution, a casting speed can be controlled to be 0.6-2.1 m/min according to different square billet sizes. Then, the continuous casting billet is slowly cooled in a slow cooling pit for a slow cooling time of not less than 24 hours.

In addition, in the forging or rolling step of the manufacturing method of the present invention, when forging is performed, it can be directly forged to a final finished product size; when rolling is performed, either the steel slab may be directly rolled to a final finished product size, or the steel slab may be first rolled to a specified intermediate slab size, then heated and rolled to a final finished product size. Among them, the heating temperature of the intermediate slab may be controlled to be 1050-1250° C., and the holding time may be controlled to be 3-24 hours.

In addition, in the finishing step of the manufacturing method of the present invention, the finishing process includes scalping and heat treatment of round steel and non-destructive inspection for ensuring quality. In the finishing step, the scalping process performed as required may include: turning scalping or grinding wheel scalping, etc.;

the heat treatment process performed as required may include annealing, isothermal annealing, and the like; the non-destructive inspection performed as required may include ultrasonic inspection, magnetic powder inspection, and the like.

Preferably, in the heating step, the steel slab is first heated to be not higher than 700° C. in a preheating section, and then is continuously heated to be not higher than 980° C. in a first heating section. And after heat preservation at the temperature, continue to heat to 950-1200° C. in a second heating section. Then, after heat preservation at the temperature, enter a soaking section having a temperature of 1050-1250° C. And after heat preservation at the temperature, proceed with subsequent rolling or forging.

In the above technical solution, compared with the prior art, the technical solution adopted in the heating step of the manufacturing method of the present invention has a higher temperature in the soaking section. The higher temperature in the soaking section can be beneficial to improve the compositional uniformity and the structural uniformity of the continuously cast billet during a diffusion process of steel slab heating. At this temperature, precipitates also have a faster solid solution rate, so that a high rolling heating temperature will cause more dissolution of originally undissolved precipitate particles in the steel, increase the concentration of microalloying elements in the matrix, and precipitate more and more dispersed particles upon subsequent cooling. In addition, only after the rolling heating temperature is increased, the final rolling temperature can be increased, resulting in more complete recovery and recrystallization of austenite after rolling, and more uniform precipitate distribution.

Preferably, in the manufacturing method of the present invention, in the forging or rolling step, the final forging or final rolling temperature is controlled to be 900° C. or more.

In the forging or rolling step of the manufacturing method of the present invention, after the steel slab is discharged from a furnace, high-pressure water can be used to remove scales and oxide skin, and the initial forging or initial rolling temperature is controlled to be 1150-1250° C., and the final forging or final rolling temperature is controlled to be 900° C. or more. This is because under this process, it is beneficial for N to desolve from a gamma solid solution and bond with microalloying elements in the steel to form nitrides.

It should be noted that, N has less solubility in $\alpha$-Fe than in $\gamma$-Fe, and due to the excitation of phase transformation, two peaks of the precipitation amount are caused. If the final forging or final rolling temperature is low, the peak precipitation of precipitates will cause non-uniform distribution of precipitates and insufficient recovery and recrystallization, resulting in anisotropy in the microstructure. Therefore, the final forging or final rolling temperature is 900° C. or more, resulting in a uniform dispersed distribution of fine precipitate. In addition, increasing the final forging or final rolling temperature will result in finer grains, which increases the difference between the average grain diameter of ferrite after transformation of supercooled austenite and a spacing between manganese-rich bands, and reduces the tendency of the manganese-rich bands to form pearlite, thereby reducing the banded structure.

The beneficial effects of the present invention are as follows:

1. According to the present invention, the steel for the gear shaft which can keep austenite grains stable under the above high-temperature conditions can be obtained by reasonably controlling chemical components. In the present invention, the contents of the microalloying elements Nb, Al and V and carbon and nitrogen elements are mainly controlled reasonably to ensure that carbonitride precipitates MX have a proper size and quantity, which limits the movement of austenite grain boundaries, and enable the austenite grains of the steel for the carburized gear shaft of the present invention to maintain appropriate grain size and stability at a high temperature. Among them, Nb and Al are main elements for forming precipitates in the present invention, the effect of V and Ti elements in controlling the grain size of high-temperature austenite in the present invention is not obvious, and it is easy for the V and Ti elements to complex with Nb to form large inclusions, thereby affecting the properties of precipitates of Nb, and thus, the V and Ti elements are considered as impurity elements in the present invention to be controlled in a low range, thereby avoiding the occurrence of large-grain harmful inclusions in the steel, ensuring the stable production quality of the steel, reducing the production cost of the steel, and realizing mass production on a bar production line.
2. The steel for the high-temperature carburized gear shaft of the present invention does not contain or only contains a small amount of precious metal elements such as Ni, Mo, Cu, V and the like, which can control the type and quantity of alloying elements in the steel under the premise of ensuring high-temperature carburizing, high hardenability, narrow bandwidth and free cutting and the like, thereby improving the applicability of the steel. The austenite grain size, hardenability and cost competitiveness of the steel for the high-temperature carburized gear shaft obtained by adopting the element composition and manufacturing method of the present invention are superior to those in the existing patent technology.
3. In the present invention, by increasing the heat treatment temperature in the heating, forging or rolling stage, the recovery and recrystallization of austenite after forging or rolling is more sufficient, and nano-sized carbonitride precipitates are uniformly dispersed in matrix steel, and the grain stability of austenite during high-temperature carburizing is further improved.
4. By using the technical solution of the present invention, the steel for the gear shaft which can undergo vacuum carburizing at a high temperature of being up to 960° C. and even 1000° C. or above, and can maintain austenite grains stability during carburizing, and avoid the phenomenon of mixed crystals and coarse grains can be obtained. The grain size of this steel after vacuum carburizing at a temperature of being up to 1000° C. for 4 hours is stably maintained at 5-8 grades, and the properties thereof reach the service performance indexes of the steel for the gear shaft. By using the steel of the present invention, the carburizing temperature of the steel can be as high as 960° C. or more, and carburizing under such high temperature conditions can greatly shorten the carburizing time of the gear shaft, reduce the production cost of a gear, reduce carbon dioxide emission, save energy and protect the environment, and have broad industrial application prospects.

DETAILED DESCRIPTION

Embodiments of the present invention will be described below with specific embodiments, and other advantages and effects of the present invention will be readily apparent to those skilled in the art from the disclosure of this specification. Although the present invention will be described in connection with preferred embodiments, it is not intended that the features of the present invention are only limited to this embodiment. On the contrary, the description of the invention in connection with the embodiments is intended to cover other alternatives or modifications that may be derived based on the claims of the present invention. The following description contains numerous specific details in order to provide a thorough understanding of the present invention. The present invention may also be practiced without these details. In addition, some specific details will be omitted from the description in order to avoid confusing or obscuring the focus of the present invention. It should be noted that the examples of the present invention and the features in the examples can be combined with each other without conflict.

Examples 1-8 and Comparative Examples 1-4

Steels for a high-temperature carburized gear shaft in Examples 1-8 are all manufactured by using the following steps:

(1) smelting and casting are carried out according to the chemical composition shown in the following Table 1: wherein the smelting can be carried out by using a 50 kg vacuum induction furnace, a 150 kg vacuum induction furnace, or a 500 kg vacuum induction furnace, or the smelting also can be carried out by using electric furnace smelting+external refining+vacuum degassing, or the smelting can be carried out by using converter smelting+external refining+vacuum degassing. And the casting can be carried out by die casting or continuous casting.

(2) Heating: a steel slab is first heated to be not higher than 700° C. in a preheating section, and then continues to be heated in a first heating section, wherein a set heating temperature is not higher than 980° C. At this stage, the temperature of the steel slab is 600-980° C.; after heat preservation, continue to heat to 950-1200° C. in a second heating section, and enter a soaking section after heat preservation. The temperature of the soaking section is 1050-1250° C., and the temperature of a core of the steel slab and the temperature of the surface of the steel slab are kept the same by heat preservation.

(3) Forging or rolling: the final forging or final rolling temperature is controlled to be 900° C. or more.

(4) Finishing: the finishing includes scalping or annealing or normalizing.

Specific processes for the steels for the high-temperature carburized gear shaft in Examples 1-8 and steels in Comparative examples 1-4 are as follows:

Example 1: Smelting is carried out on a 50 kg vacuum induction furnace according to the chemical composition shown in Table 1 below. Molten steel is cast into steel ingots, and heated and forged into billets, and the steel ingots are first heated to 700° C. in a preheating section, then continue to heat to 900° C. in a first heating section. And after heat preservation, continue to heat to 1000° C. in a second heating section. After heat preservation, enter a soaking section having a temperature of 1100° C. Then, after heat preservation, proceed with subsequent forging to finally create bars with Φ60 mm, wherein the final forging temperature is controlled to be 910° C., and after forging, normalize at 920° C. for 100 minutes.

Example 2: Smelting is carried out on a 150 kg vacuum induction furnace according to the chemical composition shown in Table 1 below. Molten steel is cast into steel ingots, heated and forged into billets, and the steel ingots are first heated to 650° C. in a preheating section, then continue to heat to 950° C. in a first heating section. And after heat preservation, continue to heat to 1100° C. in a second heating section. Then, after heat preservation, enter a soaking section having a temperature of 1200° C., and after heat preservation, proceed with subsequent forging to finally create bars with Φ75 mm, wherein the final forging temperature is controlled to be 1000° C., and after forging, perform turning scalping.

Example 3: perform electric furnace smelting according to the chemical composition shown in Table 1, and perform refining and vacuum treatment, and then cast into a continuously cast billet of 320 mm×425 mm, and the continuously cast billet is first heated to 600° C. in a preheating section, then continues to heat to 980° C. in a first heating section. And after heat preservation, continue to heat to 1200° C. in a second heating section. Then, after heat preservation, enter a soaking section having a temperature of 1220° C., and after heat preservation, perform subsequent rolling. The steel slab is discharged from a heating furnace, and begins to be rolled after high-pressure water descaling and finally is rolled into bars with Φ120 mm, wherein a final rolling temperature is controlled to be 1000° C. After rolling, perform air cooling, annealing treatment at 650° C. for 12 hours, and inspect by ultrasonic inspection and magnetic powder inspection and the like.

Example 4: perform electric furnace smelting according to the chemical composition shown in Table 1, and perform refining and vacuum treatment, and then cast into a continuously cast billet of 280 mm×280 mm, and the continuously cast billet is first heated to 620° C. in a preheating section, then continues to heat to 950° C. in a first heating section. And after heat preservation, continue to heat to 1150° C. in a second heating section. Then, after heat preservation, enter a soaking section having a temperature of 1200° C. And after heat preservation, proceed with subsequent rolling. The steel slab is discharged from a heating furnace, and begins to be rolled after high-pressure water descaling, and finally is rolled into bars with Φ90 mm, wherein a final rolling temperature is controlled to be 970° C. After rolling, perform air cooling, grinding wheel scalping, and inspect by ultrasonic inspection and magnetic powder inspection and the like.

Example 5: perform electric furnace smelting according to the chemical composition shown in Table 1, and perform refining and vacuum treatment, and then cast into a continuously cast billet of 320 mm×425 mm, and the continuously cast billet is first heated to 600° C. in a preheating section, then continues to heat to 950° C. in a first heating section. And after heat preservation, continue to heat to 1200° C. in a second heating section. Then, after heat preservation, enter a soaking section, having a temperature of 1230° C. And after heat preservation, perform subsequent rolling. The steel slab is discharged from a heating furnace, and begins to be rolled into an intermediate slab after high-pressure water descaling, wherein the first final rolling temperature is controlled to be 1050° C. and the intermediate slab has a size of 220 mm×220 mm. The intermediate slab is then preheated to 680° C., and subsequently is first heated to 1050° C., then heated to 1200° C. And after heat preservation, perform soaking, the soaking temperature being 1220° C., and the slab after soaking is discharged from the furnace, and begins to be rolled after high-pressure water descaling, thereby obtaining a finished product bar having a specification of Φ50 mm, wherein the second final rolling temperature is controlled to be 950° C. After rolling, perform air cooling, isothermal annealing treatment, i.e., keeping at 900° C. for 90 min, followed by air cooling to 600° C., and keeping for 120 min, then discharge from the furnace, and air cooling, and then inspect by ultrasonic inspection and magnetic powder inspection and the like.

Example 6: perform electric furnace smelting according to the chemical composition shown in Table 1, and perform refining and vacuum treatment, and then cast into a continuously cast billet of 280 mm×280 mm, and the continuously cast billet is first heated to 680° C. in a preheating section, then continues to heat to 900° C. in a first heating section. And after heat preservation, continue to heat to 1180° C. in a second heating section. Then, after heat preservation, enter a soaking section having a temperature of 1200° C. And after heat preservation, perform subsequent rolling. The steel slab is discharged from a heating furnace, and begins to be rolled into an intermediate slab after high-pressure water descaling, wherein the first final rolling temperature is controlled to be 1000° C. and the intermediate slab has a size of 140 mm×140 mm. The intermediate slab is then preheated to 700° C., and subsequently heated to 1100° C., then heated to 1220° C. And after heat preservation, perform soaking, the soaking temperature being 1220° C., and the slab after soaking is discharged from the furnace, and begins to be rolled into a finished product bar having a specification of Φ20 mm after high-pressure water descaling, wherein the second final rolling temperature is controlled to be 920° C. After rolling, perform air cooling, turning scalping, and inspect by ultrasonic inspection and magnetic powder inspection and the like.

Example 7: perform converter smelting according to the chemical composition shown in Table 1, and perform refining and vacuum treatment, and then cast into a die cast slab, and the cast slab is first heated to 620° C. in a preheating section, then continues to heat to 950° C. in a first heating section. And after heat preservation, continue to heat to 1150° C. in a second heating section. Then, after heat preservation, enter a soaking section having a temperature of 1200° C. And after heat preservation, perform subsequent rolling. The steel slab is discharged from a heating furnace, and begins to be rolled after high-pressure water descaling and finally is rolled into bars with Φ110 mm, wherein the final rolling temperature is controlled to be 970° C. After rolling, perform air cooling, grinding wheel scalping, and inspect by ultrasonic inspection and magnetic powder inspection and the like.

Example 8: perform converter smelting according to the chemical composition shown in Table 1, and perform refining and vacuum treatment, and then cast into a die cast slab, and the cast slab is first heated to 600° C. in a preheating section, then continues to heat to 950° C. in a first heating section. And after heat preservation, continue to heat to 1200° C. in a second heating section. Then, after heat preservation, enter a soaking section having a temperature of 1230° C. And after heat preservation, perform subsequent rolling. The steel slab is discharged from a heating furnace, and begins to be rolled into an intermediate slab after high-pressure water descaling, wherein the first final rolling temperature is controlled to be 1050° C. and the intermediate slab has a size of 260 mm×260 mm. The intermediate slab is then preheated to 680° C., and subsequently is first heated to 1050° C., and then heated to 1200° C. And after heat preservation, perform soaking, the soaking temperature being 1220° C., and the slab after soaking is discharged from the furnace, and begins to be rolled into a finished product bar having a specification of Φ60 mm after high-pressure water descaling, wherein the second final rolling temperature is controlled to be 950° C. After rolling, perform air cooling, and then inspect by ultrasonic inspection and magnetic powder inspection and the like.

Steels in Comparative examples 1 and 2 are from commercial materials.

Comparative example 3: The implementation method thereof is the same as that in Example 1, including: perform smelting in a 50 kg vacuum induction furnace according to the chemical composition shown in Table 1, cast molten steel into steel ingots, heat and forge into billets, and the steel ingots are first heated to 700° C. in a preheating section, then continue to heat to 900° C. in a first heating section. And after heat preservation, continue to heat to 1000° C. in a second heating section. Then, after heat preservation, enter a soaking section having a temperature of 1100° C. And after heat preservation, perform subsequent forging and finally forge into bars with Φ60 mm, wherein the final forging temperature is controlled to be 910° C., and after forging, normalize at 920° C. for 100 minutes.

Comparative example 4: The implementation method thereof is the same as that in Example 5, including: perform electric furnace smelting according to the chemical composition shown in Table 1, and perform refining and vacuum treatment, and then cast into a continuously cast billet of 320 mm×425 mm, and the continuously cast billet is heated to 600° C. in a preheating section, then continues to heat to 950° C. in a first heating section. And after heat preservation, continue to heat to 1200° C. in a second heating section. Then, after heat preservation, enter a soaking section having a temperature of 1230° C. And after heat preservation, perform subsequent rolling. The steel slab is discharged from a heating furnace, and begins to be rolled into an intermediate slab after high-pressure water descaling, wherein the first final rolling temperature is controlled to be 1050° C. and the intermediate slab has a size of 220 mm×220 mm. The intermediate slab is then preheated to 680° C., and subsequently is first heated to 1050° C., and then heated to 1200° C. And after heat preservation, perform soaking, the soaking temperature being 1220° C., and the slab after soaking is discharged from the furnace, and begins to be rolled into a finished product bar having a specification of Φ50 mm after high-pressure water descaling, wherein the second final rolling temperature is controlled to be 950° C. After rolling, perform air cooling, isothermal annealing treatment, i.e., keeping at 900° C. for 90 min, followed by air cooling to 600° C., and keeping for 120 min, then discharge from the furnace, and perform air cooling, and then inspect by ultrasonic inspection and magnetic powder inspection and the like.

Table 1 lists the mass percentage of each chemical element and a microalloying element coefficient $r_{M/X}$ of the steels for the high-temperature carburized gear shaft in Examples 1-8 and comparative steels in Comparative examples 1-4.

Table 2 lists the specific process parameters of the steels for the high-temperature carburized gear shaft in Examples 1-8 and comparative steels in Comparative examples 1-4 in the above process steps.

TABLE 1

(%, the balance being Fe and other inevitable impurities besides P, B, V, and Ti)

| No. | C | Si | Mn | P | S | Cr | Ni | Mo | Cu | Al | V | Ti | Nb | N | B | $r_{M/X}$ |
|---|---|---|---|---|---|---|---|---|---|---|---|---|---|---|---|---|
| Example 1 | 0.17 | 0.28 | 1.35 | 0.007 | 0.015 | 1.39 | 0.24 | 0.07 | 0.19 | 0.037 | 0.013 | 0.007 | 0.016 | 0.02 | 0.0002 | 1.60 |
| Example 2 | 0.22 | 0.06 | 0.81 | 0.006 | 0.018 | 1.16 | 0.21 | 0.08 | 0.16 | 0.046 | 0.018 | 0 | 0.013 | 0.017 | 0.0003 | 1.36 |
| Example 3 | 0.18 | 0.27 | 1.3 | 0.006 | 0.016 | 1.4 | 0.19 | 0.04 | 0.13 | 0.039 | 0 | 0 | 0.027 | 0.02 | 0.0002 | 2.48 |
| Example 4 | 0.22 | 0.27 | 0.92 | 0.006 | 0.011 | 0.99 | 0.18 | 0.06 | 0.19 | 0.041 | 0.013 | 0.002 | 0.003 | 0.018 | 0.0004 | 0.61 |
| Example 5 | 0.19 | 0.12 | 1.31 | 0.008 | 0.024 | 0.86 | 0.22 | 0.07 | 0.06 | 0.027 | 0.015 | 0.001 | 0.014 | 0.009 | 0.0004 | 1.67 |
| Example 6 | 0.20 | 0.34 | 1.33 | 0.01 | 0.034 | 1.02 | 0.15 | 0.06 | 0.13 | 0.021 | 0.003 | 0.002 | 0.025 | 0.006 | 0.0003 | 2.91 |
| Example 7 | 0.21 | 0.28 | 1.28 | 0.008 | 0.022 | 1.25 | 0.1 | 0.03 | 0.15 | 0.041 | 0.015 | 0 | 0.015 | 0.02 | 0.0002 | 1.40 |
| Example 8 | 0.22 | 0.31 | 1.08 | 0.011 | 0.027 | 1.32 | 0 | 0 | 0 | 0.031 | 0.011 | 0.001 | 0.012 | 0.014 | 0.0003 | 1.24 |
| Comparative example 1 | 0.16 | 0.14 | 1.35 | 0.009 | 0.031 | 1.01 | 0.01 | 0.02 | 0.01 | 0.038 | 0.013 | 0.001 | 0.002 | 0.013 | 0.0002 | 0.70 |
| Comparative example 2 | 0.2 | 0.13 | 1.29 | 0.012 | 0.025 | 1.36 | 0.18 | 0.07 | 0.1 | 0.026 | 0.003 | 0.002 | 0.001 | 0.016 | 0.0002 | 0.40 |
| Comparative example 3 | 0.21 | 0.27 | 1.35 | 0.005 | 0.014 | 1.22 | 0.16 | 0.06 | 0.09 | 0.036 | 0.014 | 0.021 | 0.032 | 0.012 | 0.0003 | 3.05 |
| Comparative example 4 | 0.23 | 0.28 | 1.33 | 0.006 | 0.016 | 1.13 | 0.1 | 0.05 | 0.11 | 0.04 | 0.018 | 0 | 0 | 0.017 | 0.0002 | 0.36 |

Note: $r_{M/x}$=(20*[Nb]/93−[V]/51+[Al]/27)/([N]/14+[C]/120), wherein each chemical element in the formula is substituted with a numerical value before the percentage sign of the percentage content by mass of the corresponding chemical element.

TABLE 2

| No. | Step (1) Smelting mode | Step (2) Heating temperature of a preheating section (° C.) | Step (2) Temperature of a first heating section (° C.) | Step (2) Temperature of a second heating section (° C.) | Step (2) Temperature of a soaking section (° C.) | Step (3) Final forging or final rolling temperature (° C.) | Intermediate slab size | Bar specification |
|---|---|---|---|---|---|---|---|---|
| Example 1 | Smelting in a 50 kg vacuum induction furnace | 700 | 900 | 1000 | 1100 | 910 | — | Φ60 mm |
| Example 2 | Smelting in a 150 kg vacuum induction furnace | 650 | 950 | 1100 | 1200 | 1000 | — | Φ75 mm |
| Example 3 | Electric furnace smelting | 600 | 980 | 1200 | 1220 | 1000 | — | Φ120 mm |
| Example 4 | Electric furnace smelting | 620 | 950 | 1150 | 1200 | 970 | — | Φ90 mm |
| Example 5 | Electric furnace smelting | 600<br>680 | 950<br>1050 | 1200<br>1200 | 1230<br>1220 | 1050<br>950 | 220 mm × 220 mm | Φ50 mm |
| Example 6 | Electric furnace smelting | 680<br>700 | 900<br>1100 | 1180<br>1220 | 1200<br>1220 | 1000<br>920 | 140 mm × 140 mm | Φ20 mm |
| Example 7 | Converter smelting | 620 | 950 | 1150 | 1200 | 970 | — | Φ110 mm |
| Example 8 | Converter smelting | 600<br>680 | 950<br>1050 | 1200<br>1200 | 1230<br>1220 | 1050<br>950 | 260 mm × 260 mm | Φ60 mm |
| Comparative example 1 | Electric furnace smelting | — | — | — | — | — | — | Φ60 mm |
| Comparative example 2 | Electric furnace smelting | — | — | — | — | — | — | Φ90 mm |
| Comparative example 3 | Smelting in a 50 kg vacuum induction furnace | 700 | 900 | 1000 | 1100 | 910 | — | Φ60 mm |
| Comparative example 4 | Electric furnace smelting | 600<br>680 | 950<br>1050 | 1200<br>1200 | 1230<br>1220 | 1050<br>950 | 220 mm × 220 mm | Φ50 mm |

In Table 2 above, Examples 5, 6, and 8 and Comparative example 4 have two columns of parameters in Step (2) and Step (3) in the above process of the present invention because the steel slab is first rolled to a specified intermediate slab size, and then heated and rolled again to a final finished product size during rolling in the above three Examples.

The obtained steels for the high-temperature carburized gear shaft in Examples 1-8 and comparative steels in Comparative examples 1-4 are respectively sampled and subjected to a simulated carburizing quenching test, a hardenability test and a hardness test, and the test results of the obtained steels in the Examples and Comparative examples are respectively shown in Table 3.

The relevant methods for the simulated carburizing quenching test, hardenability test and hardness test are described below:

simulated carburizing quenching test: hold at 940° C. for 5 hours; hold at 960° C., 980° C. and 1000° C. for 4 hours, respectively; hold at 1020° C. for 3 hours; and hold at 1050° C. for 2 hours, then perform water quenching, and take samples to observe the structures of the steels in the Examples and Comparative examples, and evaluate their austenite grain sizes according to the standard ASTM E112.

Hardenability test: for the steels in the Examples and the steels in the Comparative examples, samples are taken and prepared from hot-rolled round steel according to the national standard GB/T 225, and subjected to an end hardenability test (Jominy test) with reference to GB/T 5216, wherein the normalizing temperature is controlled to be 920±10° C., and the quenching temperature is controlled to be 870±5° C. And a Rockwell hardness test is conducted according to GB/T 230.2 to obtain a hardness value (HRC) at a specific location, such as hardness at 9 mm from a quenching end, i.e., J9 mm. The above process parameters may also be determined by negotiation.

Table 3 lists the test results of the steels for the high-temperature carburized gear shaft in Examples 1-8 and the comparative steels in Comparative examples 1-4.

As can be seen from Table 3, after the steels for the high-temperature carburized gear shaft in Examples 1-8 of the present invention are subjected to simulated carburizing at four temperatures not exceeding 1000° C. in the simulated carburizing quenching test, the austenite grain sizes are maintained within the range of 5-8 grades, and no phenomena such as mixed crystals or abnormal coarse grains are observed. And the workability of the resulting steels meets the technical requirements, wherein the steels in Example 1 and Example 3 have a grain size of 5 grade after being heated at 1040° C. for 2 h.

The mixed crystal phenomenon (1 grade) is observed after the comparative steel in Comparative example 2 is subjected to simulated carburizing and quenching at a temperature of 960° C., wherein 6 (1) represents an average grain size of 6 grade, and 1 grade abnormal coarsening occurring in a local region. After continuing to increase the simulated carburizing temperature of the comparative steels in Comparative examples 1, 3, and 4 to 980° C. or higher, the abnormal growth of the austenite grains becomes severer, wherein 5.5 (1) represents an average grain size of 5.5 grade, and 1 grade coarsening occurring in a local region. In Comparative example 3, it can be seen that TiN type inclusions are present in the steel, adversely affecting the fatigue performance. The comparative steel in Comparative example 1 has a lower hardenability, and does not meet the requirements of 20MnCrS5H high-hardenability gear steel specified in EN 10084-2008.

To sum up, it can be seen that, in the present invention, by a reasonable chemical composition design and an optimized process, the steel for the high-temperature carburized gear shaft according to the present invention can have high temperature austenite grain stability, high hardenability, narrow hardenability bandwidth and good high-temperature grain stability. It is also free-cutting and suitable for high-temperature carburizing. And it has a hardenability of 30-43 HRC at a representative position J9 mm, and maintains 5-8 grades of the austenite grain size before and after the high-temperature vacuum carburizing at up to 1000° C. A bar rolled or forged with the high-hardenability steel for the

TABLE 3

| No. | Grain size of austenite under the heat preservation condition of 940° C. × 5 h (Grade) | Grain size of austenite under the heat preservation condition of 960° C. × 4 h (Grade) | Grain size of austenite under the heat preservation condition of 980° C. × 4 h (Grade) | Grain size of austenite under the heat preservation condition of 1000° C. × 4 h (Grade) | Grain size of austenite under the heat preservation condition of 1020° C. × 3 h (Grade) | Grain size of austenite under the heat preservation condition of 1050° C. × 2 h (Grade) | Hardenability at J9 mm (HRC) |
|---|---|---|---|---|---|---|---|
| Example 1 | 7.5 | 7 | 6.5 | 6 | 5.5 | 5 | 39 |
| Example 2 | 8 | 7.5 | 6 | 6 | 5.5 | 5.5 (1) | 31 |
| Example 3 | 7 | 7 | 6 | 6 | 5 | 5 | 38 |
| Example 4 | 7 | 7 | 6 | 6 | 5.5 (1) | 5 (0) | 32 |
| Example 5 | 6.5 | 6.5 | 6.5 | 6 | 5.5 (1) | 5 (0) | 33 |
| Example 6 | 7 | 7 | 6 | 6 | 5 | 5 (1) | 40 |
| Example 7 | 7 | 7 | 6.5 | 6 | 5 (1) | 5 (0) | 39 |
| Example 8 | 7.5 | 6.5 | 6 | 5 | 5 (1) | 5 (0) | 38 |
| Comparative example 1 | 6 | 5.5 | 5.5 (1) | 5 (00) | 5.5 (1) | 4 (0) | 29 |
| Comparative example 2 | 6 | 6 (1) | 5 (1) | 5 (0) | 5 (0) | 4 (00) | 39 |
| Comparative example 3 | 7 | 6.5 | 5.5 | 5 (00) | 5.5 (1) | 4 (0) | 41 |
| Comparative example 4 | 7 | 6 | 5 (1) | 5 (0) | 5 (0) | 4 (00) | 40 |

gear shaft can be effectively processed into a gear, and has suitable strength and toughness after heat treatment such as high-temperature carburizing. The steel for the gear shaft can be effectively applied to high-end parts such as a gearbox for an automobile or a speed reducer and a differential for a new energy vehicle, and has good application prospects and value.

In addition, the combinations of various technical features in the present invention are not limited to the combinations described in the claims of the present invention or the combinations described in the specific examples, and all technical features described in the present invention can be freely combined or integrated in any way unless there is a conflict between the technical features.

It should also be noted that the examples listed above are only specific examples of the present invention. Obviously, the present invention is not limited to the above examples, and similar variations or modifications made accordingly that can be directly derived or easily conceived by those skilled in the art from the contents disclosed by the present invention should fall within the protection scope of the present invention.

What is claimed is:

1. A steel for a high-temperature carburized gear shaft, comprising the following chemical components in percentage by mass: 0.17-0.22% C, 0.06-0.35% Si, 0.80-1.40% Mn, 0.010-0.035% S, 0.80-1.40% Cr, 0.020-0.046% Al, 0.006-0.020% N, 0.002-0.027% Nb, 0.02% or less V, 0.01% or less Ti, 0<Cu≤0.20%, 0.10% or less Mo, and B<0.0010%.

2. The steel for a high-temperature carburized gear shaft according to claim 1, wherein the balance is Fe and inevitable impurities.

3. The steel for a high-temperature carburized gear shaft according to claim 2, wherein the steel further comprises, in percentage by mass, 0.015% or less P, 0.0020% or less O, 0.0002% or less H, and 0.003% or less Ca.

4. The steel for a high-temperature carburized gear shaft according to claim 2, wherein the steel for a high-temperature carburized gear shaft has a hardenability of 30-43 HRC at a representative position J9 mm, and maintains 5-8 grades of an austenite grain size before and after high-temperature vacuum carburizing.

5. The steel for a high-temperature carburized gear shaft according to claim 1, wherein the steel further comprises elements Ni, in percentage by mass, 0<Ni≤0.25%.

6. The steel for a high-temperature carburized gear shaft according to claim 5, wherein the steel further comprises, in percentage by mass, 0.015% or less P, 0.0020% or less 0, 0.0002% or less H, and 0.003% or less Ca.

7. The steel for a high-temperature carburized gear shaft according to claim 5, wherein the steel for a high-temperature carburized gear shaft has a hardenability of 30-43 HRC at a representative position J9 mm, and maintains 5-8 grades of an austenite grain size before and after high-temperature vacuum carburizing.

8. The steel for a high-temperature carburized gear shaft according to claim 1, wherein the steel further comprises, in percentage by mass, 0.015% or less P, 0.0020% or less O, 0.0002% or less H, and 0.003% or less Ca.

9. The steel for a high-temperature carburized gear shaft according to claim 1, wherein the contents of the elements Nb, V, Al, N and C in the steel for a high-temperature carburized gear shaft satisfy the following formula: a microalloying element coefficient $r_{M/X}$=(20*[Nb]/93−[V]/51+[Al]/27)/([N]/14+[C]/120), and the microalloying element coefficient $r_{M/X}$ ranges from 0.5 to 3.0, wherein each chemical element in the formula is substituted with a numerical value before a percentage sign of the percentage content by mass of the corresponding chemical element.

10. The steel for a high-temperature carburized gear shaft according to claim 1, wherein the steel for a high-temperature carburized gear shaft has a hardenability of 30-43 HRC at a representative position J9 mm, and maintains 5-8 grades of an austenite grain size before and after high-temperature vacuum carburizing.

11. A manufacturing method for the steel for a high-temperature carburized gear shaft according to claim 1, comprising the steps of:

smelting and casting;

heating;

forging or rolling; and finishing.

12. The manufacturing method for the steel for a high-temperature carburized gear shaft according to claim 11, wherein in the heating step, a heating temperature of a preheating section is not higher than 700° C., a temperature of a first heating section is not higher than 980° C., a temperature of a second heating section is 950-1200° C., and a temperature of a soaking section is 1050-1250° C.

13. The manufacturing method for the steel for a high-temperature carburized gear shaft according to claim 11, wherein in the forging or rolling step, a final forging temperature or a final rolling temperature is 900° C. or more.

14. The manufacturing method for the steel for a high-temperature carburized gear shaft according to claim 11, wherein the finishing step comprises at least one of scalping, annealing and tempering.

* * * * *